United States Patent [19]

Rausing

[11] 3,943,682

[45] Mar. 16, 1976

[54] METHOD FOR MAKING, FILLING AND SEALING CONTAINERS THROUGH A RECLOSEABLE FILLING OPENING

[75] Inventor: Anders Ruben Rausing, Rome, Italy

[73] Assignee: Tetra Pak Developpement SA, Lausanne, Switzerland

[22] Filed: June 10, 1974

[21] Appl. No.: 478,088

[30] Foreign Application Priority Data

June 14, 1973 Sweden ..... 7308364

[52] U.S. Cl. ..... 53/37; 53/41

[51] Int. Cl.[2]. B65B 43/00; B65B 43/39; B65B 1/04

[58] Field of Search ..... 53/29, 37, 39, 25, 40, 53/41, 243, 43, 376, 377, 284, 242, 266, 267, 268, 36, 127, 22 A; 93/36 DA, 55.1 P; 229/5.5, 7 R

[56] References Cited

UNITED STATES PATENTS

| | | | |
|---|---|---|---|
| 2,089,958 | 8/1937 | Hothersall | 93/36 DA |
| 2,290,879 | 7/1942 | Hothersall | 53/37 X |
| 2,338,019 | 12/1943 | Baker et al. | 229/5.5 |
| 2,341,379 | 2/1944 | Householder et al. | 229/5.5 |
| 2,398,404 | 4/1946 | Brooks | 229/5.5 X |
| 2,399,241 | 4/1946 | Merkle | 229/5.5 |
| 2,437,114 | 3/1948 | Moore | 229/5.5 |
| 3,018,184 | 1/1962 | Martin | 53/127 X |
| 3,057,130 | 10/1962 | Helwig | 53/127 UX |
| 3,269,079 | 8/1966 | Schmied | 53/127 UX |
| 3,561,982 | 2/1971 | Oeth | 53/39 X |
| 3,590,557 | 7/1971 | Vogel | 53/39 X |

*Primary Examiner*—Travis S. McGehee
*Assistant Examiner*—Horace M. Culver
*Attorney, Agent, or Firm*—Pierce, Scheffler & Parker

[57] ABSTRACT

A method for making, filling and sealing a packing container in which the container has a lug provided in one end plate which can be partially removed to provide a filling opening and which can be reclosed and sealed in the end plate after filling.

7 Claims, 5 Drawing Figures

Figure 1:
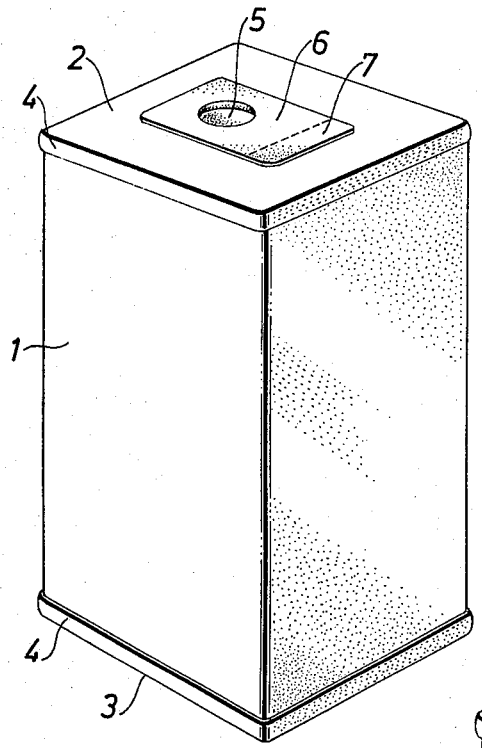

METHOD FOR MAKING, FILLING AND SEALING CONTAINERS THROUGH A RECLOSEABLE FILLING OPENING

The present invention relates to a method for the manufacture, filling and closing of packing containers intended for fluid materials comprising a prismatic container body and end plates covering the said container body as well as packing containers manufactured in accordance with the method.

In the manufacture of packing containers for fluid materials such as e.g. milk or fruit juice paper and cardboard, plastics or combinations of the said materials are frequently used as packing material. The demands made on a package of the abovementioned type are that it shall be tight, it shall give good protection to the contents, it shall be convenient to use, it shall be rational to manufacture, handle and transport, and finally, it shall be cheap.

A number of packing containers of disposable character of various designs are on the market which constitute more or less successful compromises of the abovementioned demands. Since the price of the packing material is the altogether dominating factor which determines the price of the finished packing container, it is advantageous to use a packing material which is as cheap as possible without waiving the demand for tightness and for protection of contents and to design the packing container so that the quantity of packing material consumed is as small as possible in relation to the volume of the packing container.

The known parallelepipedic packing containers are designed so that the packing material, by folding, is made to overlap in two or more layers along important surfaces, which means that the material consumption is relatively great. Such packing containers, which are manufactured from a blank which is folded and formed to a container with an open end, through which the contents are introduced, have the inconvenience that the contents can be introduced only up to a certain level, since otherwise the contents during the processing of the packing container in the packing machine will splash over the edge of the open packing container. It is generally known that a splash margin of about 2 cm at the top of the packing container is required to prevent the contents from splashing over the edge when the packing container is tranferred from a filling station to a closing station in the packing machine. Owing to the presence of a splash margin in the packing container, the closed package will contain a certain quantity of enclosed air which may amount to 10 – 15% of the total volume, and since the oxygen of the air has a detrimental effect on the quality of milk and juice products, it is desirable to reduce the quantity of enclosed air as much as possible.

It is the object of the present invention to provide a method for the manufacture of a packing container which on the one hand has a very small quantity of enclosed air and requires a quantity of packing material which is economically adapted to the volume of the packing container, and on the other hand has very small quantities of overlapping material, which contributes to the quantity of packing material and thus is matched very economically to the volume of the packing container. The invention is characterized in that the said end plates are applied, before the filling operation, to the container body and are tightly sealed to the opening edge regions of the same, and that a preferably lug-like portion, punched out previously in one of the said end plates, is withdrawn to provide a filling opening communicating with the interior of the packing container. Thus a fill pipe for the introduction of the intended contents may be passed down through the said filling opening, whereupon the contents are introduced into the packing container, and finally the said withdrawn, lug-like portion is folded back towards the opening in the end plate and is united in a tight and mechanically durable manner with the end plate from which it has been punched. The inventions is characterized further in that the said lug is produced by punching or cutting lines of a depth which is less than the thickness of the end plate. The punching is carried out on both sides of the end wall in such a manner that the punched or cut lines are somewhat laterally displaced in relation to one another and that the material in the end wall between the said punched or cut lines forms overlapping parts, one part belonging to the lug and the other part to the end wall.

Figure 2:
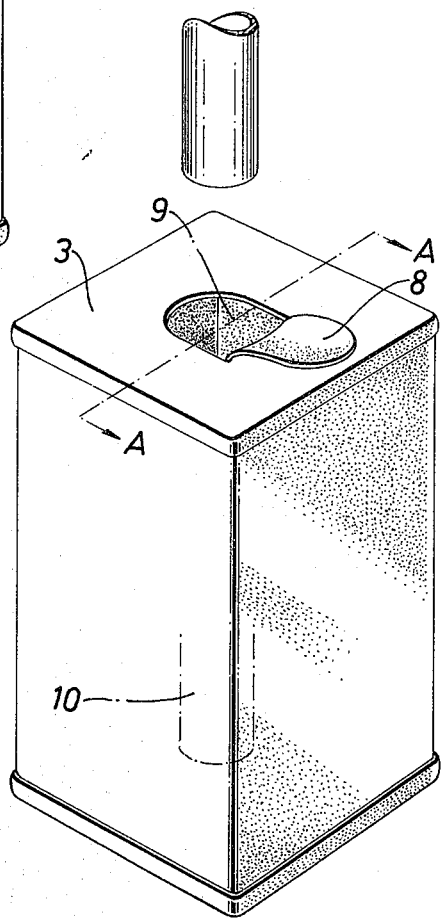
Figure 3:
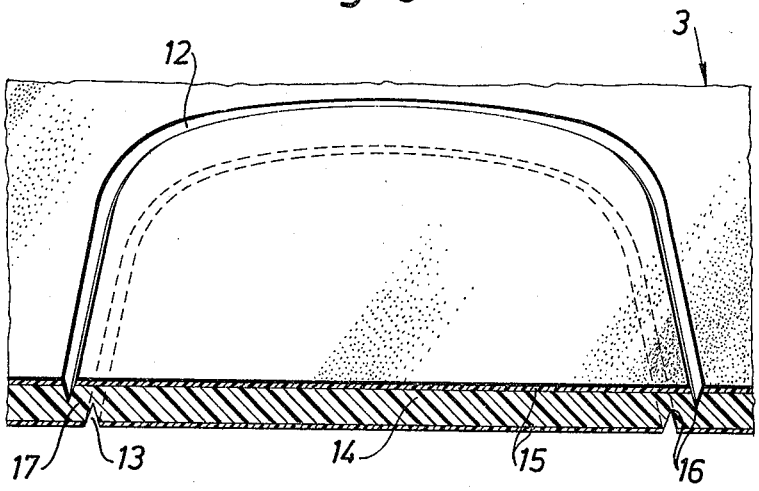
Figure 4:
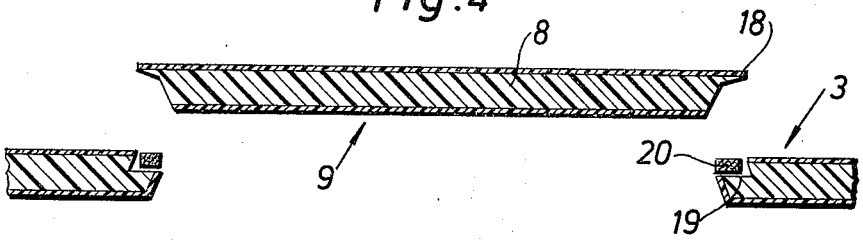
Figure 5:
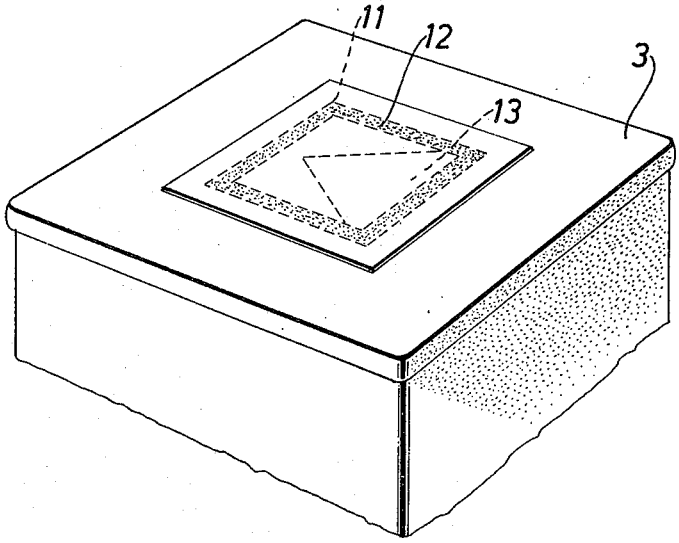

In the following, the invention will be described with reference to the enclosed diagrammatic drawing, in which FIG. 1 shows a packing container in accordance with the invention after completion, FIG. 2 shows a packing container in accordance with the invention during its filling operation, FIGS. 3 and 4 show enlarged cross-sections along line A—A of FIG. 2 through the filling opening, and FIG. 5 shows the end portion of a packing container, the filling lug of which is fixed in place with the help of an outer cover strip.

Packing containers in accordance with the invention can be manufactured of several different kinds of packing material, and the package body and the end plates may be manufactured of the same material or of different materials. In the following description it is assumed that the packing container in accordance with FIG. 1 has a container body 1 of a cardboard material coated on both sides with thermoplastic material and end plates 2,3 of foamed plastic material which on both sides are coated with homogeneous plastic material. The container body 1 may be manufactured of a foamed plastic base layer coated with homogenous plastic material, if desired and in the following where the container body is said to consist of cardboard or papr material coated with plastic, it will be understood that it can also be made advantageously of foamed plastic material which is coated with homogeneous plastic material. The container body 1 is manufactured from a packing material web, from which sheets or blanks are cut and which subsequently, e.g. through rolling up on a mandrel or the like, are formed to a prismatic body with square or rectangular cross-section. By sealing the plastic coatings of the packing material to each other along the longitudinal edges of the said blank a tight longitudinal joint is obtained. In the event the container body 1 is manufactured from cardboard materials, an absorbant cut edge is exposed towards the interior of the packing container, and it is necessary in many cases to cover up this cut edge either by means of a separate plastic strip or else e.g. through double-folding of the inner edge region. If the container body 1 is made of foamed plastic material no problem of absorption arises, because the foamed plastic material is nonabsorbent.

As mentioned earlier, the end openings of the container body 1 are closed by means of end plates 2,3 which with their edge regions 4 are folded down against the sides of the container body 1 and fixed thereto. The said fixing of the edge regions 4 of the end plates 2,3 against the container body 1 is accomplished by providing the edge regions 4 of the end plates, in advance, with a binding means that can be activated by heat, so-called "hot melt," which consists of mixtures of plastic material and waxes in such proportions that the desired melting temperature is obtained. Since the melting temperature of hot-melt material in general is substantially lower than the melting temperature of the plastic material included in the packing laminate, it is possible to carry out the sealing at a temperature which is considerably lower than the melting temperaure of the plastic material. In addition to covering the edge regions 4 of the end plates 2,3 with hot-melt coating it may be suitable in certain cases also to cover the upper and lower edge regions of the container body with a hot-melt material so as to obtain a tight and mechanically durable seal with the end plates.

The end plates 2,3 too are made preferably from a web of packing material which, as mentioned earlier, consists of a base layer of foamed plastic material, preferably polystyrene foamed plastic material of a thickness of 0.5 – 2 mm, and thin outer coatings of homogeneous plastic material. The end plates 2,3 are punched out from the web and are pre-treated with hot-melt coating, and provided with an emptying hole and filling hole before being applied to the container body. The upper end plate 2 in the example shown comprises an emptying hole 5 which is covered with a cover strip 6, the outermost part of which consists of a pull-tab 7. The cover strip 6 may consist of a homogeneous plastic strip which in the area of the emptying hole 5 can be drawn down into the same whereby the portion drawn down may be designed so that its largest outside dimension somewhat exceeds the inside dimension of the emptying hole 5, a so-called spring-fastener effect being obtained, that is to say, that part of the cover strip 6 which is drawn down into the emptying hole 5 can, after the cover strip 6 has been torn off and the emptying hole 5 has been exposed, be pressed back firmly into the emptying hole 5, for a dustproof closure of the package. The cover strip 6 is sealed to the upper surface of the end plate 2 along a sealing region which extends around the emptying hole 5, the strength of the seal being adjusted so that the cover strip 6 can be torn off relatively easily from the surface of the end plate 2. The end plate 2 with emptying device, which may be designed in some other manner than that described here, or also without any opening device, is prefabricated and prepared to be applied to the container body 1 in the packing machine, which container body 1 is then preferably fitted on a mandrel.

The end plate 3 as shown in FIG. 2 is adapted to comprise a filling opening 9 through which the contents are to be introduced into the packing container and the end plate 3 also is prepared and prefabricated in that a hot-melt coating is applied to the edge regions 4 and that a lug 8 is punched out of the end plate 3 and is folded back so that the filling hole 9 is accessible.

When the container body 1 has been provided with the upper end plate 2 the packing container is turned so that the lower opening of the container body 1 is directed upwards, whereupon the end plate 3 is applied to the said upwardly turned opening of the container body 1. When the end plate 3 has been fixed and sealed to the lower opening edge region of the container body which, as mentioned previously, is turned upwards during the working operation, the contents are filled into the packing container with the help of a fill pipe 10 which is introduced into the packing container close to its downwardly directed end plate 2, whereupon the contents are allowed to flow through the fill pipe 10, which fills up the packing container at the same time as the fill pipe 10 is raised at the same rate as the level of the contents rises in the packing container. Owing to the fact that the filling hole 9 is small in relation to the cross-sectional area of the packing container, the risk of spilling through splashing is small and the packing container can therefore be filled practically up to the filling hole 9. If the filling and the subsequent closure of the filling hole 9 are done whilst the packing container is at standstill or moves at an even speed without acceleration or retardation, lateral movements of the contents are avoided, which means that the risk of splashing is further reduced. When the packing container is filled with its contents and the fill pipe 10 has been removed, the lug 8 is shut over the filling hole 9 and fixed to the end plate 3 either by means of an outer cover strip in the manner as shown in FIG. 5 or else by means of a binding agent that can be activated by heat in a manner which will be described in greater detail in the following.

Since the filling through the filling hole 9 cannot be done with filling nozzles of the size which could be used if the whole end area of the package were open, it is appropriate to fill the packing container relatively slowly, and so that the overall capacity of the packing machine should not be diminished because of the slow filling, it is appropriate to fill, at the same time, a number, e.g. two, four or six packing containers.

As mentioned previously, it is desirable to reduce the quantity of air in the closed packing container to an absolute minimum, since the oxygen of the air has a detrimental effect on the quality of the contents. In packages of the type described here it is difficult, however, on the one hand completely to fill the package with its contents without the contents pouring over the edge of the emptying hole 9, whilst on the other hand it is troublesome after opening of the packing container to pour the contents out without spilling if the package has been filled with its contents right to the top. This problem can be remedied, however, by pressing in the sidewalls of the container body 1 during the filling operation or after the filling operation has been completed, and keeping the wall portions pressed-in until the filling hole 9 has been closed again by means of the lug 8. When the packing container has been tightly closed, the pressure against the walls of the container body 1 can be released, these walls largely remaining in their pressed-in position, however, since the packing container is so tight that no air can penetrate into the same. When the packing container is opened when the cover strip 6 is removed, air will enter the package, and the sidewalls of the container body 1 will re-assume their normal position, whereby the volume of the packing container increases and consequently the level of the contents drops a little so that the risk of a spill, when the container is emptied of its contents, is reduced or avoided. To obtain the minimum possible quantity of enclosed air in the package the same can first be filled with its contents to a level somewhat below the level of the filling hole 9, whereupon the walls of the container body 1 may be pressed in so that the contents come practically up to the emptying hole 9, whereupon the same is closed. When the packing container is opened the level of the contents drops back to the position it had on completion of the filling operation.

In FIG. 5 is shown how a V-shaped lug 13*a*, which is incorporated in the end plate 3, is covered by means of a cover strip 11 which is sealed to the end plate 3 at least along a portion 12 around the lug 13*a*. The application of the cover strip 11 involves naturally a technical complication and a certain increase in the cost of the packing container, so that it is desirable in certain cases to be able to avoid the said cover strip 11. In FIG. 3 and 4 is shown a design of the end plate 3 with filling hole 9 which does not require any outer cover strip, which means that the end plate 3, like the end plate 2 prepared with emptying hole 5, can be completely arranged in advance in a special machine to be combined later with the container body, whereupon the filling hole can be closed without any additional cover strip having to be used. FIG. 3 shows a greatly enlarged section of the end plate 3, the section having been taken through that area of the end plate 3 which is adapted to from the lug 8 by which the filling opening 9 is exposed. As can be seen from FIG. 3, scores or punched lines 12,13 have been provided in the end plate 3 in such a manner, that one punched line 12 is arranged on the outside of the end plate 3 and a second punched line 13 is arranged on the inside of the end plate 3. The two punched lines or scores 12,13 are thus punched or scored on different sides of the end plate 3, and as can be seen from FIG. 3, the depth of punching is such that the outer homogeneous plastic coatings 15 are wholly penetrated whilst by contrast the punchings do not wholly penetrate the base layer 14. The depth of punching for both punched lines 12,13 are chosen so that the inner parts 16 of the punched lines 12 and 13 reach to the same level in the base layer 14 or extend a little past one another.

The punched lines 12,13 are moreover somewhat laterally displaced in relation to one another, which means that an area 17 of the base layer will exist between the inner parts 16 of the punched lines 12,13. To form the lug 8 and the filling opening 9 the punched lines are arranged parallel with one another in U-shape or V-shape in such a manner, that the filling opening 9 will be located substantially centrally in the end plate 3 and, owing to the punched lines 12,13 being parallel and laterally displaced in relation to one another, the punched line 12, which is arranged on the outside of the end plate 3 will enclose a larger surface than the punched line 13.

The lug 8 and filling opening 9 prepared in the abovementioned manner are formed so that, as shown in FIG. 4, when the lug 8 is pressed upwards, the portion 17 mentioned earlier between the punched lines 12,13 is split to form parts 18,19 overlapping one another, the part 18 being located on the lug 8 and the part 19 being integral with the remaining part of the end plate 3. The splitting of the end plate between the punched lines may occur either in the base layer 14 itself, since foamed polystyrene can easily be split, or the splitting may also occur between the homogeneous plastic layer 15 and the foam layer 14, if the strength of lamination between the layers is not too great. Both, or at least one of the parts 18,19 overlapping one another maybe provided along split surface(s) with a seal 20 of hot melt and the lug may be withdrawn from the filling opening 9 and folded back against the end plate 3.

The end plates 3 manufactured in the abovementioned manner are sealed to the one opening of the container body 1 with the help of hot melt or some other adhesive agent which is activated through the application of heat. For securing the end plate 3 to the container body no help can be obtained from an inner mandrel onto which the container body is fitted, but it has been found that the edge of the container body 1 is stiff enough to permit a tight and durable seal between the end plate 3 and the container body 1.

After the filling operation, as described earlier, the lug 8 is replaced in the filling opening 9, the overlapping portions 18,19 being brought into contact with one another and heat being applied to activate the hot melt 20, with whose help the lug 8 is sealed in shut position over the filling opening 9. After the filling and closing operation the packing container is turned so as to assume the position shown in FIG. 1, whereupon the packing container is ready for delivery.

The packing container in accordance with the invention and the method for its manufacture can also be adapted for sterile contents, which implies that the packing material and the assembled packing container has to be sterilized before the sterile contents are introduced into the package. Such a treatment and filling of the packing containers ought to take place in a known manner in a chamber wherein a sterile atmosphere is maintained so as to prevent a re-infection of the already sterilized packing containers.

The sterilization of the packing containers may be arranged in such a manner that the packing material in the form of a web, from which the container body 1 and the end plates 2,3 are manufactured, before processing is dipped in or is treated with, a sterilizing chemical, e.g. hydrogen peroxide, possibly in the presence of heat, since heat accelerates the sterilization process. The so sterilized packing material can then be cut up into blanks and formed into the container body 1 and the end plates 2,3 respectively, which are assembled together in the said sterile chamber, within which they are then filled and closed. It is also possible to carry out the sterilization treatment only after the container body and the end plates have been made and possibly assembled, and this may be done e.g. by means of a hydrogen peroxide mist with a subsequent hot air treatment so as to vaporize the hydrogen peroxide.

It is also possible to sterilize the packing containers with the help of electronic irradiation, and it is preferably here to use electronic irradiation of low energy content so as to avoid harmful secondary effects in the form of x-ray radiations. The advantage of sterilization by electronic irradiation is that no residual products of the sterilizing agent remain on the packing material which might afterwards come into contact with the packed foodstuff, neither will any moistening of the packing material occur. The sterilization by electronic irradiation can be arranged so that the packing containers prior to filling with the contents are led past a source of radiation which irradiates electrons on the one hand towards the outside of the packing container, and on the other hand through the filling hole 9 into the inside of the packing container, which causes the inside of the packing container to be completely sterilized owing to the electrons exciting secondary electrons from the inner wall surface of the packing container, which, together with the primary electrons reflected against the wall surfaces, bring about sterilization of the interiors of the packing containers by electronic irradiation. The fill pipe 10 may also be placed so that it is affected by the electronic irradiation and be kept sterile on the outside. The abovementioned sterilization by electronic irradiation should here too be carried out in a closed room in which a sterile atmosphere is maintained so as to prevent re-infection of the already sterilized packing containers, and the said closed chamber should have, moveover, a thin layer of a screening metal, e.g. lead, so as to collect any X-ray radiation which might be generated by the electrons used for sterilization. As in the case of chemical sterilization, the sterilized packing containers must be filled while in the said chamber with the intended sterile contents and be closed in a bacteria-tight manner before they are taken out of the chamber to the surrounding atmosphere.

As mentioned previously, the packing container in accordance with the invention is convenient to handle and to open, and it is moreover cheap, since no overdimensioning of the container body is required to avoid splashing over the edges of the container and since overlapping material layers are largely avoided.

I claim:

1. A method for making, filling and sealing packing containers for fluids in which a substantially tube-like container body of packaging material is closed at each end with an end plate of packaging material, said method comprising forming cuts in a substantially U-shaped configuration on opposed sides of one of said end plates, said cuts extending partially through the thickness of the one end plate and the cut on the outer side of the one plate lying substantially parallel to and outside the cut on the inner side of the end plate when viewed normal to the plane of the end plate, affixing the one end plate and a second end plate to the ends of the side walls of the container body to form a closed container, withdrawing and folding back that portion of the packaging material of the one end plate generally within the limits defined by the substantially U-shaped cuts therein by tearing the uncut material between the substantially U-shaped cuts to form a lug whose outer periphery extends beyond and overlaps the periphery of the filling hole formed in the one end plate when the lug is withdrawn and folded back, introducing a filling pipe into the filling hole for filling the container with a fluid, withdrawing the filling pipe, unfolding and reinserting the lug into the filling hole and securing the lug in the filling hole in a fluid tight and mechanically durable manner.

2. A method as claimed in claim 1 wherein the one end plate is affixed to the bottom of the packing container.

3. A method as claimed in claim 1 and further comprising affixing a cover strip over the reinserted lug to seal the area surrounding the lug.

4. A method as claimed in claim 1 and further comprising applying a sealing material between the overlapping portions of the periphery of the lug and the periphery of the filling hole before reinserting the lug into the filling hole.

5. A method as claimed in claim 1 wherein the end plates are composed of a laminate having a base layer of a foamed plastic material and layers of a homogeneous plastic material on both sides thereof.

6. A method as claimed in claim 5 wherein the foamed plastic material is foamed polystyrene and the layers of homogeneous plastic material are polystyrene.

7. A method as claimed in claim 1 wherein the container body is composed of a base layer of a packaging material and layers of a plastic material on both sides thereof.

* * * * *